US008109746B2

(12) United States Patent
Guidry, Jr.

(10) Patent No.: US 8,109,746 B2
(45) Date of Patent: Feb. 7, 2012

(54) PROGRESSING CAVITY PUMP/MOTOR

(75) Inventor: Michael J. Guidry, Jr., Hockley, TX (US)

(73) Assignee: Robbins & Myers Energy Systems L.P., Willis, TX (US)

( * ) Notice: Subject to any disclaimer, the term of this patent is extended or adjusted under 35 U.S.C. 154(b) by 421 days.

(21) Appl. No.: 12/483,453

(22) Filed: Jun. 12, 2009

(65) Prior Publication Data

US 2010/0316518 A1 Dec. 16, 2010

(51) Int. Cl.

| | |
|---|---|
| ***F01C 1/10*** | (2006.01) |
| ***F03C 2/00*** | (2006.01) |
| ***F03C 4/00*** | (2006.01) |
| ***F04C 18/00*** | (2006.01) |

(52) U.S. Cl. ..... 418/48; 166/178; 175/95; 175/107

(58) Field of Classification Search ..... 418/48; 415/200, 118; 166/178; 175/95, 107
See application file for complete search history.

(56) References Cited

U.S. PATENT DOCUMENTS

| | | | | |
|---|---|---|---|---|
| 3,982,858 | A * | 9/1976 | Tschirky | 418/48 |
| 3,994,163 | A * | 11/1976 | Rogers | 166/178 |
| 4,585,401 | A * | 4/1986 | Baldenko et al. | 418/48 |
| 4,711,006 | A * | 12/1987 | Baldenko et al. | 418/48 |
| 5,620,056 | A * | 4/1997 | Eppink | 175/95 |
| 2006/0006640 | A1 * | 1/2006 | Knight | 285/81 |
| 2009/0169364 | A1 * | 7/2009 | Downton | 29/407.05 |

* cited by examiner

*Primary Examiner* — Theresa Trieu
(74) *Attorney, Agent, or Firm* — Streets & Steele

(57) ABSTRACT

A progressing cavity pump/motor includes an upper stator tube (14), a lower stator tube (16), a rotor (20) sitting between the upper and lower stator tubes, and a coupling assembly (30) interconnecting the stator tubes comprising an outer sleeve (32), an inner sleeve (36) and a nut (60) for threaded engagement with at least one of the sleeves to bring a stop surface on the inner sleeve into mating engagement with the stop surface on the outer sleeve. The pump/motor is usually assembled in the field while maintaining precise axial and rotational positioning of the stator tubes.

20 Claims, 6 Drawing Sheets

PROGRESSING CAVITY PUMP/MOTOR

FIELD OF THE INVENTION

The present invention relates to a progressing cavity pump/motor of the type used in a downhole well to pump fluid to the surface or to convert hydraulic energy into mechanical energy to rotate a bit. More particularly, this invention relates to a progressing cavity pump/motor which has structurally separable upper and lower stator tubes.

BACKGROUND OF THE INVENTION

Progressing cavity pumps and motors have been used for decades in pumping applications and in hydraulic motor applications. A conventional progressing cavity pump consists of a rigid rotor having a contoured interior surface along an axial length thereof. The interior surface of the rotor mates with the exterior surface of a rotor which has a contoured exterior surface, with one additional lead on the interior of the stator. This lead difference forms cavities between the rotor and the stator which are continually progressing from one end of the stator to the other when the rotor is turning. Operation of a pump is achieved by mechanically turning the rotor, while operation of a motor is achieved by forcing fluid into one end of the stator to turn the rotor. An elastomeric or plastic material is conventionally bonded to the rigid stator tube, thereby providing a fluid tight seal between the elastomeric stator material and the outer tubular housing.

In some applications, a progressing cavity pump has an extremely long length, e.g., thirty feet or more, which makes transportation and handling of the stator difficult. During manufacturing, an elongate rotor in two or more pieces may be assembled end-to-end at the manufacturing plant using appropriate jigs. The end of one rotor section may thus be aligned with the adjacent end of another rotor section, so that rotor sections are rotationally aligned when welded together. Such direct alignment of a motor/pump housing is difficult to envision with the structural and functional requirements of a pump/motor. More specifically, the elongate stator of a pump/motor is preferably connected in the field, and does not require welding at the rig site or the use of specialized jigs.

The disadvantages of the prior art are overcome by the present invention, and an improved progressing cavity pump/motor with upper and lower stator sections and a coupling assembly for interconnecting these sections is hereinafter disclosed.

SUMMARY OF THE INVENTION

In one embodiment, a progressing cavity pump is provided for positioning along a tubular string in a well to pump fluids to the surface through the tubular string. In another embodiment, the same assembly may be used to create downhole mechanical energy from fluid transmitted downhole to the motor. The pump/motor includes an upper stator tube, a lower stator tube, and a rotor extending axially between the upper stator tube and the lower stator tube. The exterior of the rotor and the interior of the stator tubes have contoured surfaces. A coupling assembly interconnects the upper stator tube and the lower stator tube while maintaining the tubes in circumferential alignment for cooperation with the rotor. The coupling assembly includes an outer sleeve supported on one of the stator tubes and having a first stop surface thereon and external threads. An inner sleeve is supported on the other of the tubes, and circumferentially aligns the upper and lower tubes. The inner sleeve has a second stop surface for engagement with the first stop surface when the pump/motor is assembled, and a nut with internal threads for threaded engagement with the external threads on the outer sleeve.

According to another embodiment, a stator as discussed above is provided for a pump/motor, with a stator cooperating with a rotor having an external profile and rotatable within the stator, with a plurality of axially moving chambers between the rotor and the stator.

These and further features and advantages of the present invention will become apparent from the following detailed description, wherein reference is made to the figures in the accompanying drawings.

DETAILED DESCRIPTION OF PREFERRED EMBODIMENTS

Figure 1:
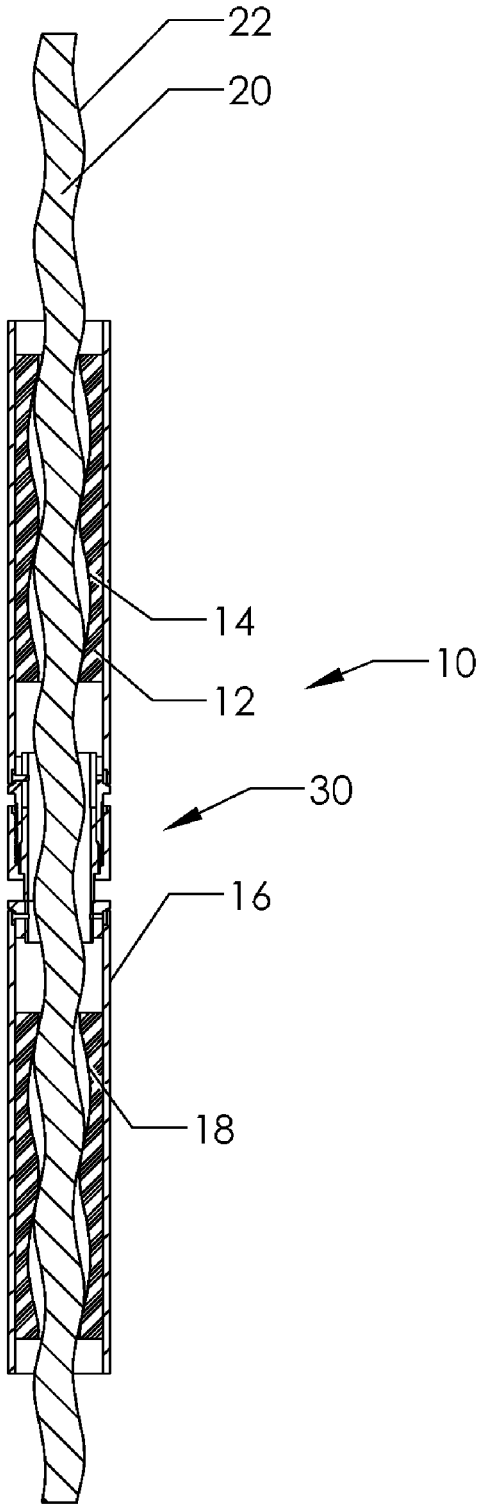
FIG. 1 is a simplified view of a pump/motor according to the present invention.

FIG. 1 is a cross-sectional view of a progressing cavity pump/motor 10, which is positionable along a tubular string in a well to either pump fluids to the surface through the tubular string or to create downhole mechanical energy from fluid transmitted downhole to the pump/motor, e.g., to rotate a bit. The pump/motor 10 includes an upper stator tube 12 having an upper contoured interior surface 14 along an axial length thereof, and a lower stator tube 16 having a lowered contoured interior surface 18 along the axial length thereof. The rotor 20 extends axially between the upper stator tube and the lower stator tube and, as shown in FIG. 1, frequently extends vertically above the upper end of the stator tube, and below a lower end of the stator tube. Rotor 20 has an exterior contoured surface 22 creating progressing cavities between the upper contoured interior surface and the contoured exterior surface, and between the lowered contoured interior surface and the contoured exterior surface when the rotor rotates with respect to both the upper stator tube and the lower stator tube. FIG. 1 also illustrates a coupling assembly 30 for interconnecting the upper stator tube 12 and the lower stator tube 16 while maintaining the tubes circumferentially aligned for cooperation with the rotor.

Figure 2:
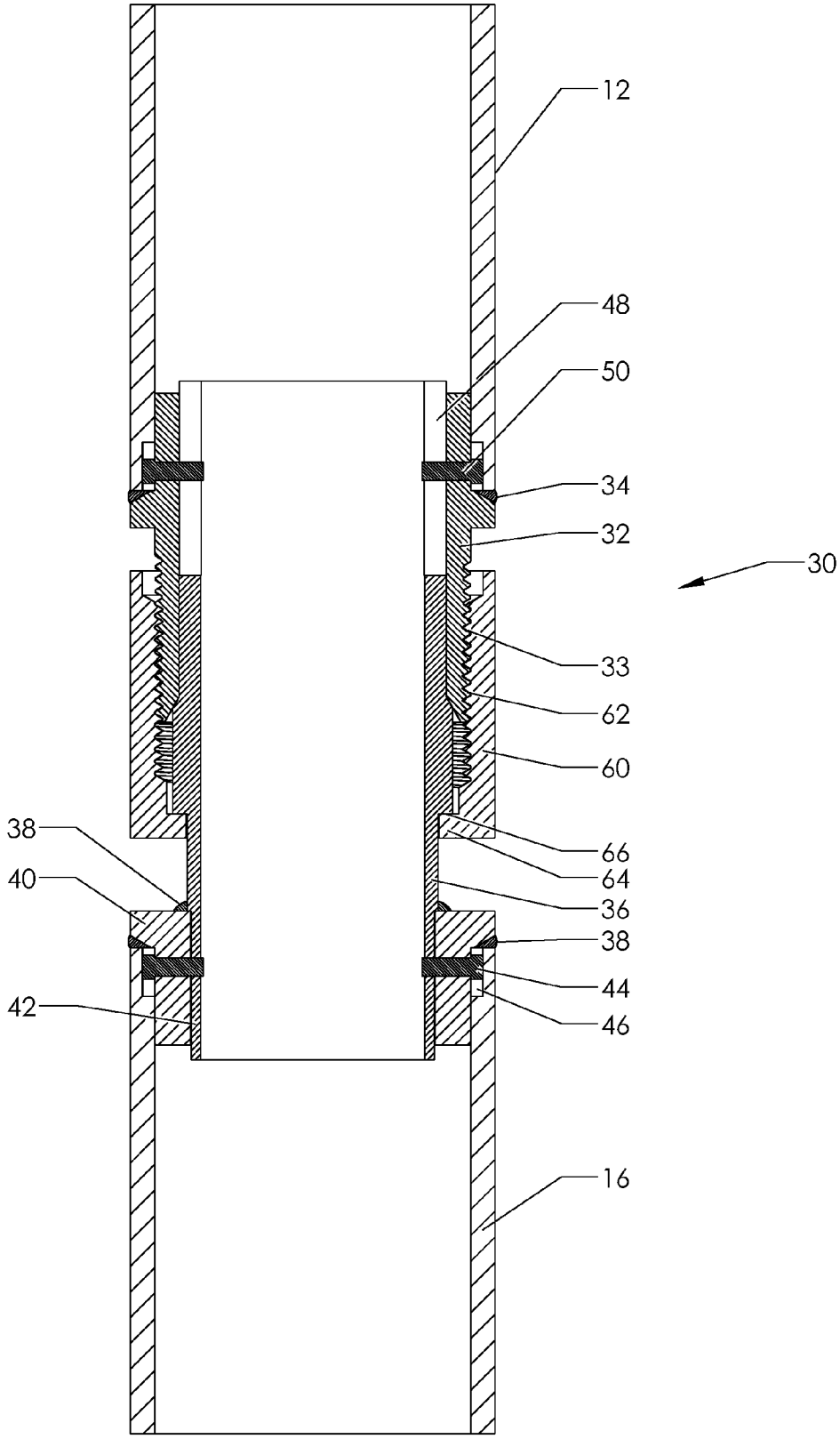
FIG. 2 is an enlarged view illustrating a coupling assembly for interconnecting a lower end of one stator tube and an upper end of another stator tube.

FIG. 2 is a cross-sectional view of the coupling 30 shown in FIG. 1, with the elastomeric layer forming the contoured surfaces 14, 18 removed for clarity of the depicted components. Coupling assembly 30 includes a radially outer sleeve 32 supported at either the lower end of the upper stator tube or the upper end of the lower stator tube. In the FIG. 2 embodiment, the outer sleeve 32 is fixed to the lower end of the upper stator tube 12 by weld 34 and has external threads 33 thereon. When the weld 34 is made at a manufacturing facility, the outer sleeve 32 may be circumferentially aligned with the tube 12 by various conventional means, so that both the circumferential and axial positioning of the outer sleeve 32 with respect to the tube 12 is known and fixed. Inner sleeve 36 is shown axially secured to ring member 40 by pins 44, and ring member 40 is connected by welds 38 to the upper end of the lower stator tube 16, and the inner sleeve 36. More specifically, ring member 40 and through may be threaded at 42 to a lower end of the sleeve 36 with pins 44 each extending through the ring 40 and through the lower end of the inner sleeve 36, with a pin head positioned within slot 46, so that the axial and circumferential position of the inner sleeve 36 with respect to the lower housing 16 is known and fixed.

The inner sleeve 36 extends between the lower stator tube 16 and the upper stator tube 12, and the upper end of the inner sleeve 36 has a plurality of elongate slots 48 each receiving a pin 50 therein. In this manner, the circumferential position of the upper stator tube 12 with respect to the upper end of the inner sleeve 36 is known, and similarly the circumferential position of the lower housing 16 with respect to the sleeve 36 is known. Sleeve 36 thus circumferentially aligns the upper stator tube and the lower stator tube as a function of the axial spacing between these tubes. The exact axial position between the tubes is achieved by engagement of stop surface 54 (see FIG. 3) on the inner sleeve 36 with the stop surface 52 on the outer sleeve 32. Preferably these surfaces are coplanar so that planar-to-planar contact is achieved. More particularly, the angle of each stop surface preferably is from 50° to 80° relative to the central axis of the coupling assembly, so that substantial surface area is available for transmitting high axial forces.

Figure 3:
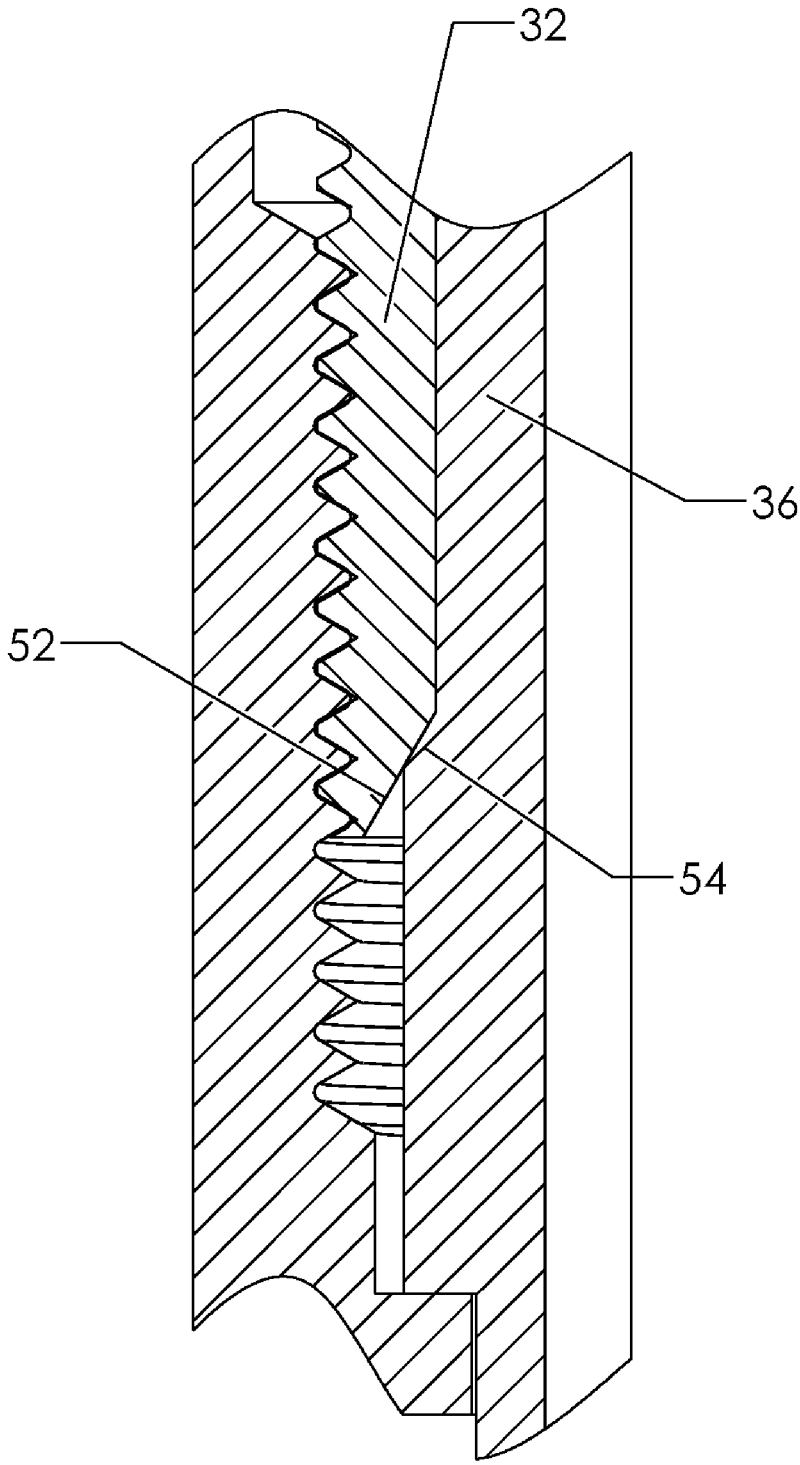
FIG. 3 is an enlarged cross-sectional view illustrating the threaded connection of the outer sleeve with a nut and a shoulder between the outer sleeve and the inner sleeve.

FIGS. 2 and 3 also depict a nut 60 having internal threads 62 for threaded engagement with the external threads 33 at the lower end of the outer sleeve 32. The nut 60 includes a flange member 64 for engagement with the stop surface 66 on the inner sleeve, as shown in FIG. 2, so that tightening the nut 60 causes the flange member to engage the stop surface 66 while bringing the tapered surfaces 52 and 54 into mating engagement.

Figure 4:
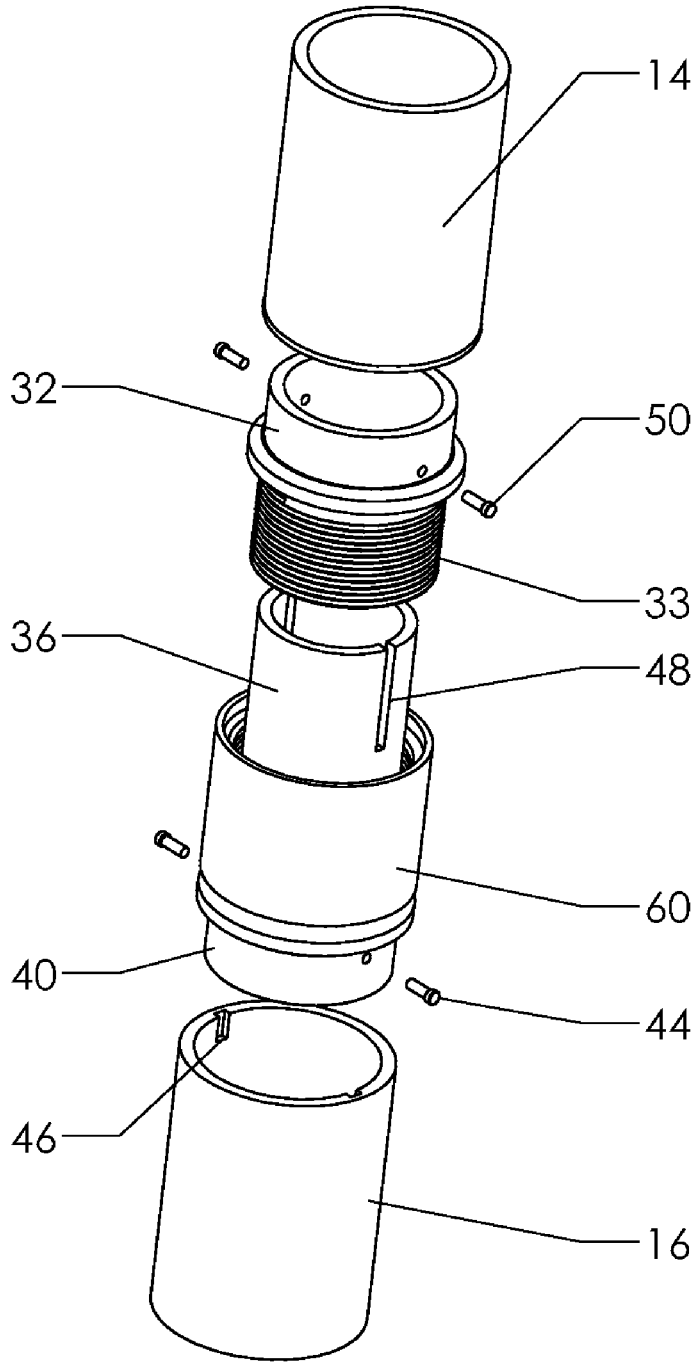
FIG. 4 is an exploded view of the coupling generally shown in FIG. 2.

FIG. 4 is an exploded pictorial view of a coupling assembly 10. Pins 50 pass through the outer sleeve 32, with the pin heads fitting within a slot (not shown in FIG. 4, but shown in FIG. 2) in the lower end of tube 14. The outer sleeve includes threads 33 for mating engagement with threads 62 on the nut 60. The inner sleeve 36 is shown with elongate slots 48 each for receiving one of the pins 50.

FIG. 4 depicts ring 40 positioned with respect to lower end of sleeve 36, so that pins 44 secure ring 40 to sleeve 36. A portion of each pin 44 will be positioned within a respective slot 46 in the upper end of the lower tube 16 when the coupling is fully assembled. The ring 40 as shown in FIG. 4 is engaging the bottom of nut 60.

For the embodiment discussed above, the contoured interior surfaces along the length of both the upper stator tube and the lower stator tube are formed from an elastomeric material which is securely bonded to an outer tubular housing. In other embodiments, the outer housing itself may have a contoured interior surface, so that a uniform thickness elastomeric layer may be bonded to the outer contoured surface of this revised housing. In still other embodiments, no elastomeric layer is provided, and the interior contoured surface of the metal stator tube creates a progressing cavity when a rotor with an exterior contoured surfaces is rotated therein.

For the embodiment which utilizes elastomeric material, this material is preferably cut back several inches from all weld joints to prevent any rubber in the stator from becoming burned during the welding process. This break in engagement between the rotor and the stator is acceptable since production losses are small over the length where the elastomeric material is cut back.

A coupling as disclosed herein can be turned end-to-end, so that the outer sleeve is attached to the lower stator tube and the inner sleeve is affixed to the upper stator tube. The coupling as disclosed herein achieves a known and consistent orientation between both the upper and lower tube contoured interior surfaces and the exterior contoured surface of the rotor. Although only two alignment pins per stator tube are shown for purposes of clarity, a larger number of pins may be used to reduce the dimensional variance with regard to stator orientation.

Figure 5:
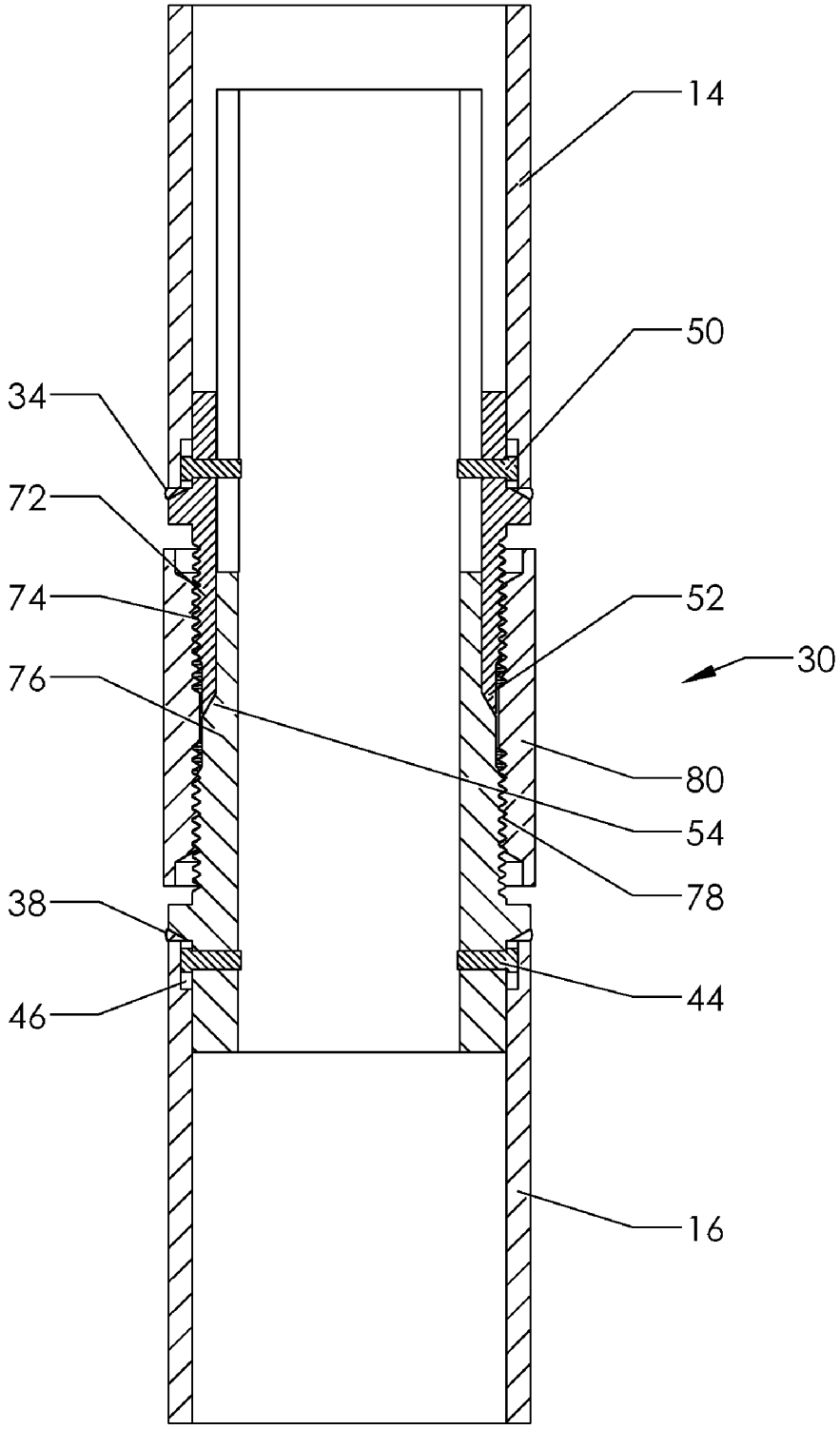
FIG. 5 is a cross-sectional view of an alternate embodiment of a stator coupling assembly.

For the embodiment as shown in FIG. 5, a nut is threaded to both the inner sleeve and the outer sleeve. The components in FIG. 5 which are functionally the same as components in FIG. 2 are provided the same reference numerals. In the FIG. 5 embodiment, the radially outer sleeve 72 is provided with external left-hand threads 74, while the radially inner sleeve 76 is provided with external right-hand threads 78. Inner sleeve 72 is welded at 34 to the upper stator tube 14, while the inner sleeve 76 is secured by pin 44 directly to the lower stator sleeve 16, rather than to a ring 40 as shown in FIG. 2. The nut 80 has left-hand threads for mating with the left-hand threads 74 on the outer sleeve 72, and right-hand threads for mating with threads 78 on the inner sleeve 76. Rotation of the nut 80 thus brings inner sleeve 76 axially closer to the outer sleeve 72, so that the planar surface 54 on the inner sleeve engages planar surface 52 on the outer sleeve, thereby bringing the coupling components into rigid and secured engagement.

Figure 6:
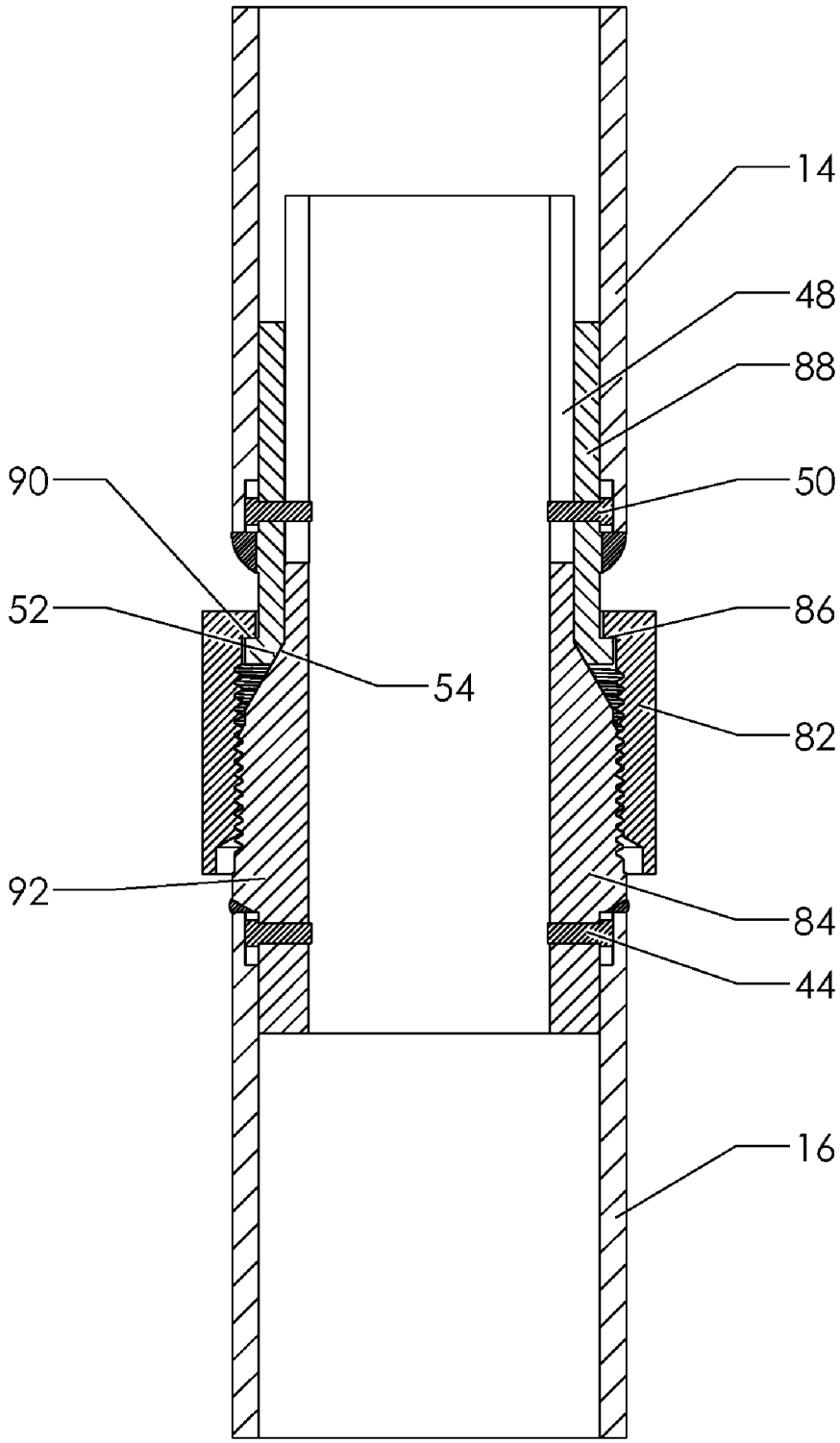
FIG. 6 is a cross-sectional view of yet another embodiment of a stator coupling.

In yet another embodiment as shown in FIG. 6, the nut 82 is threaded to the inner sleeve 84, and a stop surface 86 on the nut engages the outer sleeve 88 such that rotation of the nut causes the stop surface 90 on the nut to engage a mating surface on the outer sleeve 88, and thereby pull the outer sleeve axially toward the inner sleeve until the tapered surface 52, 54 are brought into rigid engagement. The radially inner sleeve 84 thus includes an elongate slot 48 as previously discussed, and the pins 44, 50 circumferentially align the inner and outer coupling sleeves as per the earlier embodiments. In the FIG. 6 embodiment, the radial thickness of the externally threaded end 92 of the inner sleeve is increased, allowing the nut 82 to thread to the inner sleeve while pulling the radially outer sleeve 88 downward until the mating surfaces 52, 54 engage.

For each of the embodiments disclosed herein, the lower end of the upper stator tube and upper end of the lower stator tube are provided with slots, which cooperate with pins to maintain the upper and lower tubes in circumferential alignment. Such slots are well suited for accomplishing the purposes of the invention without significantly reducing the permissible loading on the coupling assembly. Alternative designs could use keys and keyways between the inner and outer sleeve and a respective stator tube. In other embodiments, the purpose of the slots may be satisfied by a splined rotational connection between the stator tube and a respective sleeve. In all cases, rotational alignment of the inner sleeve and the outer sleeve within a tolerance of 2° or less is particularly significant so that the efficiency of the pump/motor is maintained.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A progressing cavity pump/motor for positioning along a tubular string in a well to pump fluids to the surface through the tubular string or to create downhole mechanical energy from fluid transmitted downhole to the pump/motor, comprising:

an upper stator tube having an upper contoured interior surface along an axial length thereof;

a lower stator tube structurally separate from the upper stator tube and having a lower contoured interior surface along an axial length thereof;

a rotor extending axially between the upper stator tube and the lower stator tube, the rotor having a contoured exterior surface creating progressing cavities between the upper contoured interior surface and the contoured exterior surface and between the lower contoured interior surface and the contoured exterior surface when the rotor rotates with respect to both the upper stator tube and the lower stator tube; and a coupling assembly for interconnecting the upper stator tube and the lower stator tube while maintaining the tubes in circumferential alignment for cooperation with the rotor, the coupling assembly comprising (a) an outer sleeve supported at one of a lower end of the upper stator tube and an upper end of the lower stator tube, the outer sleeve having a first stop surface thereon and an external thread thereon, (b) an inner sleeve supported on the other of the upper stator tube and the lower stator tube, the inner sleeve extending between the upper stator tube and the lower stator tube and circumferentially aligned with each of the upper stator tube and the lower stator tube, the inner sleeve having a second stop surface for engagement with the first stop surface when the coupling assembly is assembled, and (c) a nut having internal threads for threaded engagement with the external threads on the outer sleeve and engaging the inner sleeve to move axially and bring the second stop surface into engagement with the first stop surface.

2. The progressing cavity pump as defined in claim 1, further comprising:

an upper alignment member for circumferentially aligning the lower end of the upper stator tube with the inner sleeve, and a lower alignment member for aligning an upper end of the lower stator tube with the inner sleeve.

3. The progressing cavity pump as defined in claim 2, wherein each alignment member comprises an alignment pin slidable within a slot in the respective upper stator tube and lower stator tube.

4. The progressing cavity pump as defined in claim 1, wherein the inner sleeve is fixed to one of the upper stator tube and the lower stator tube by welding.

5. The progressing cavity pump as defined in claim 1, wherein a radially projecting member on the nut engages the inner sleeve to move axially and bring the second stop surface into engagement with the first stop surface.

6. The progressing cavity pump as defined in claim 1, wherein the inner sleeve moves axially with respect to the outer sleeve when the nut is rotated until the first stop surface engages the second stop surface, and the outer sleeve includes a radially outward flange for engaging an end of one of the upper stator tube and the lower stator tube.

7. The progressing cavity pump as defined in claim 1, wherein the nut engages threads on the outer sleeve which spiral oppositely to threads on the inner sleeve and bring the second stop surface into engagement with the first stop surface.

8. The progressing cavity pump as defined in claim 1, wherein each of the upper contoured interior surface and the lower contoured interior surface is formed from an elastomeric layer secured within an outer tubular shaped housing.

9. The progressing cavity pump as defined in claim 1, further comprising:

a bushing spaced between the inner sleeve and the other of the upper stator tube and the lower stator tube.

10. The progressing cavity pump as defined in claim 1, wherein each of the first stop surface and second stop surface is angled at from 50° to 80° relative to a central axis of the coupling assembly.

11. A progressing cavity pump/motor for positioning along a tubular string in a well to pump fluids to the surface through the tubular string or to create downhole mechanical energy from fluid transmitted downhole to the pump/motor, comprising:

an upper stator tube having an upper contoured interior surface along an axial length thereof;

a lower stator tube structurally separate from the upper stator tube and having a lower contoured interior surface along an axial length thereof;

a rotor extending axially between the upper stator tube and the lower stator tube, the rotor having a contoured exterior surface creating progressing cavities between the upper contoured interior surface and the contoured exterior surface and between the lower contoured interior surface and the contoured exterior surface when the rotor rotates with respect to both the upper stator tube and the lower stator tube; and a coupling assembly for interconnecting the upper stator tube and the lower stator tube while maintaining the tubes in circumferential alignment for cooperation with the rotor, the coupling assembly comprising (a) an outer metal sleeve secured at one of a lower end of the upper stator tube and an upper end of the lower stator tube, the outer sleeve having a first stop surface thereon and an external thread thereon, (b) an inner metal sleeve secured to the other of the upper stator tube and the lower stator tube, the inner sleeve extending between the upper stator tube and the lower stator tube and circumferentially aligned with each of the upper and lower stator tube by a respective upper and lower alignment member, the inner sleeve having a second stop surface for engagement with the first stop surface when the coupling assembly is assembled, and (c) a nut having internal threads for threaded engagement with the external threads on at least one of the inner sleeve and the outer sleeve to move axially and bring the second stop surface into engagement with the first stop surface.

12. The progressing cavity pump as defined in claim 11, wherein each alignment member comprises an alignment pin slidable within a slot in the respective upper stator tube and lower stator tube.

13. The progressing cavity pump as defined in claim 11, wherein a radially projecting member on the nut engages the inner sleeve to move axially and bring the second stop surface into engagement with the first stop surface.

14. The progressing cavity pump as defined in claim 11, wherein the nut engages threads on the outer sleeve which spiral oppositely to threads on the inner sleeve to bring the second stop surface into engagement with the first stop surface.

15. The progressing cavity pump as defined in claim 11, wherein each of the upper contoured interior surface and the lower contoured interior surface is formed from an elastomeric layer secured within an outer tubular shaped housing.

16. A stator of a pump/motor for either pumping fluid by rotating a rotor or rotating the rotor in response to pumped fluid, the rotor having an external profile and rotatable within the stator with a plurality of axially moving chambers between the exterior profile on the rotor and the interior profile on the stator, the stator comprising:

an upper stator tube having an upper contoured interior surface along an axial length thereof;

a lower stator tube structurally separate from the upper stator tube and having a lower contoured interior surface along an axial length thereof;

a rotor extending axially between the upper stator tube and the lower stator tube, the rotor having a contoured exterior surface creating progressing cavities between the upper contoured interior surface and the contoured exterior surface and between the lower contoured interior surface and the contoured exterior surface when the rotor rotates with respect to both the upper stator tube and the lower stator tube; and a coupling assembly for interconnecting the upper stator tube and the lower stator tube while maintaining the tubes in circumferential alignment for cooperation with the rotor, the coupling assembly comprising (a) an outer sleeve supported at one of a lower end of the upper stator tube and an upper end of the lower stator tube, the outer sleeve having a first stop surface thereon, (b) an inner sleeve supported on the other of the upper stator tube and the lower stator tube, the inner sleeve extending between the upper stator tube and the lower stator tube and circumferentially aligned with each of the upper stator tube and the lower stator tube, the inner sleeve having a second stop surface for engagement with the first stop surface when the coupling assembly is assembled, and (c) a nut having internal threads for threaded engagement with an external threads on at least one of the inner sleeve and outer sleeve to bring the second stop surface into engagement with the first stop surface.

17. A stator as defined in claim 16, further comprising:

an upper alignment member for circumferentially aligning the lower end of the upper stator tube with the inner sleeve, and a lower alignment member for aligning an upper end of the lower stator tube with the inner sleeve.

18. A stator as defined in claim 16, wherein a radially projecting member on the nut engages the inner sleeve to move axially and bring the second stop surface into engagement with the first stop surface.

19. A stator as defined in claim 16, wherein the nut engages threads on the outer sleeve which spiral oppositely to threads on the inner sleeve to bring the second stop surface into engagement with the first stop surface.

20. A stator as defined in claim 16, wherein each of the first stop surface and the second stop surface is angled at from 50° to 80° relative to a central axis of the coupling assembly.

* * * * *